US005491847A

United States Patent [19]

Shaffer

[11] Patent Number: 5,491,847

[45] Date of Patent: Feb. 20, 1996

[54] TOILET VENTILATION SYSTEM

[76] Inventor: Richard C. Shaffer, 3920 W. Vickery, Fort Worth, Tex. 76107

[21] Appl. No.: 315,089

[22] Filed: Sep. 29, 1994

[51] Int. Cl.[6] ..... E03D 9/052

[52] U.S. Cl. ..... 4/213

[58] Field of Search ..... 4/213

[56] References Cited

U.S. PATENT DOCUMENTS

| | | | |
|---|---|---|---|
| 1,122,264 | 12/1914 | Douglas | 4/213 |
| 1,298,584 | 3/1919 | Shaw | 4/213 |
| 1,862,085 | 6/1932 | Hertzog | 4/213 |
| 2,238,461 | 4/1941 | Carman | 4/213 |
| 2,432,208 | 12/1947 | Oehring | 4/213 |
| 2,747,201 | 5/1956 | Herriott | 4/213 |
| 3,059,244 | 10/1962 | Jarrett | 4/213 |
| 3,585,651 | 6/1971 | Cox | 4/213 X |
| 3,849,808 | 11/1974 | Olson et al. | 4/213 |
| 4,168,553 | 9/1979 | Studer | 4/213 X |
| 4,175,293 | 11/1979 | Stephens | 4/209 R |
| 5,054,130 | 10/1991 | Wilson | 4/213 |
| 5,199,111 | 4/1993 | Antepenko | 4/213 |

*Primary Examiner*—Robert M. Fetsuga
*Attorney, Agent, or Firm*—Arthur F. Zobal

[57] ABSTRACT

A toilet ventilation system has an intake member located directly adjacent the toilet bowl of a toilet. The intake member is coupled to a manifold which permits odors from the toilet to be transferred from the intake member on the toilet to a ventilation pipe located adjacent the toilet. A fan is located at a remote end of the ventilation pipe for drawing odors through the intake member, the manifold, and the ventilation pipe, and expelling the odors into a ventilation area. The intake member is removably located in the manifold through a manifold inlet and may be removed from the manifold. The ventilation pipe is located in the manifold through a manifold outlet. The manifold may be rotated about the ventilation pipe when the intake member has been removed from the manifold inlet, for cleaning purposes. In another embodiment, the toilet bowl has an integrally coupled exhaust manifold with a removable receptacle or sump for receiving liquids and for allowing the manifold to be readily cleaned.

6 Claims, 4 Drawing Sheets

TOILET VENTILATION SYSTEM

BACKGROUND OF THE INVENTION

1. Field of the Invention

The invention relates to a ventilation system for removing odors from a toilet and which is located directly on the toilet and has separable components which may be easily cleaned.

2. Description of the Prior Art

Toilets are typically located in small enclosed bathrooms which are susceptible to becoming filled with biological odors each time the toilet is used. Ventilation fans positioned in the ceiling of the bathroom above the toilet are commonly used to draw off odors from the bathroom. Ceiling ventilation fans are not particularly effective, however, since the fan is not located close to the toilet, the source of the odors. The ceiling ventilation fan, therefore, requires a substantial amount of time to remove the odors from the bathroom.

Toilet ventilation systems have been disclosed that are located proximate to the toilet to increase the efficiency of ventilation. For example, U.S. Pat. Nos. 4, 175,293; 4,168, 553; and 5,199,111 disclose ventilation systems located near a toilet. These systems, however, are difficult to clean.

SUMMARY OF THE INVENTION

It is an object of the invention to provide an efficient ventilation system for removing odors from a toilet that is located in close proximately to the toilet and which is easy to clean.

The ventilation system of one embodiment the invention comprises a hollow manifold having a manifold inlet and a manifold outlet. The manifold is located on a toilet adjacent the toilet bowl of the toilet. A hollow intake member having front and rear ends with inlet and outlet openings therein, respectively, is also provided. The rear end of the intake member is removably coupled to the manifold inlet. The inlet end of the intake member is positioned to extend over the toilet bowl when the rear end is located in the manifold inlet. An exhaust pipe is coupled to the manifold outlet for removing air and odor from an area about the toilet. A fan is positioned to draw air and odor through a remote end of the exhaust pipe, thereby drawing odors through the intake member, manifold, and exhaust pipe away from the toilet area.

In one aspect of the invention, the manifold is structured and arranged to rotate about the exhaust pipe in the manifold outlet so that the manifold and toilet may be easily cleaned.

In another aspect of the invention the intake member is structured and arranged to be slidably removed from and inserted into the manifold inlet so that the intake member may be easily removed from the manifold for cleaning purposes.

In another embodiment the toilet bowl has an integrally coupled exhaust manifold with a removable receptacle or sump for receiving liquids and for allowing the manifold to be readily cleaned.

DESCRIPTION OF THE PREFERRED EMBODIMENT

Figure 1:
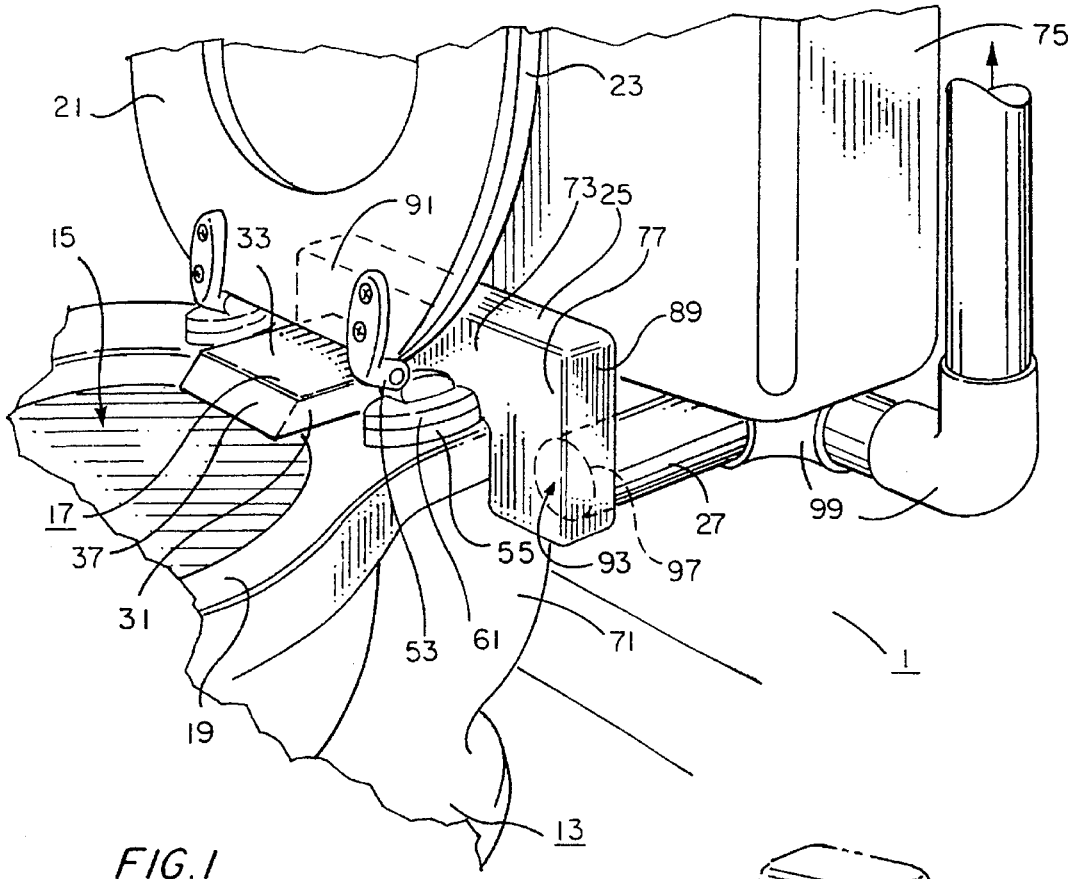
FIG. 1 is an isometric view of the toilet with the toilet ventilation system of the invention secured thereto.
Figure 5:
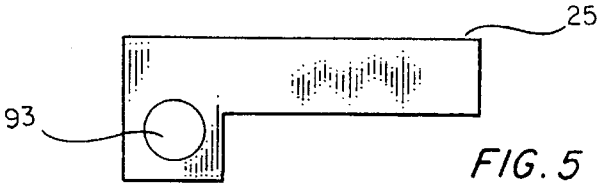
FIG. 5 illustrates the back side of the manifold.

Referring now to FIG. 1, the ventilation exhaust system 11 for a toilet of the present invention is shown positioned on toilet 13. The ventilative exhaust system is positioned close to the toilet bowl 15 of the toilet 13 to efficiently remove biological odors from the toilet area. An exhaust intake member 17 is positioned on the rim 19 of the toilet bowl 15 extending slightly over the bowl 15 to draw odors or fumes from the bowl 15 into the ventilative exhaust system 11. The exhaust intake member 17 extends from the toilet bowl 15 under the seat 21 and lid 23 of the toilet 13 to an exhaust manifold 25. The exhaust manifold 25 couples the exhaust intake member 17 and delivers odors from the intake member 17 to an exhaust ventilation pipe 27 which extends adjacent to the toilet 13. As shown in FIGS. 1 and 5, the exhaust ventilation pipe 27 delivers the odors from the manifold 25 to a ventilation area 28 outside of the area around the toilet. A ventilation fan 29 positioned at a ventilation end 30 of the pipe 27 adjacent the ventilation area 28 draws odors through the ventilation pipe 27, the manifold 25, and the intake member 17.

Figure 2:
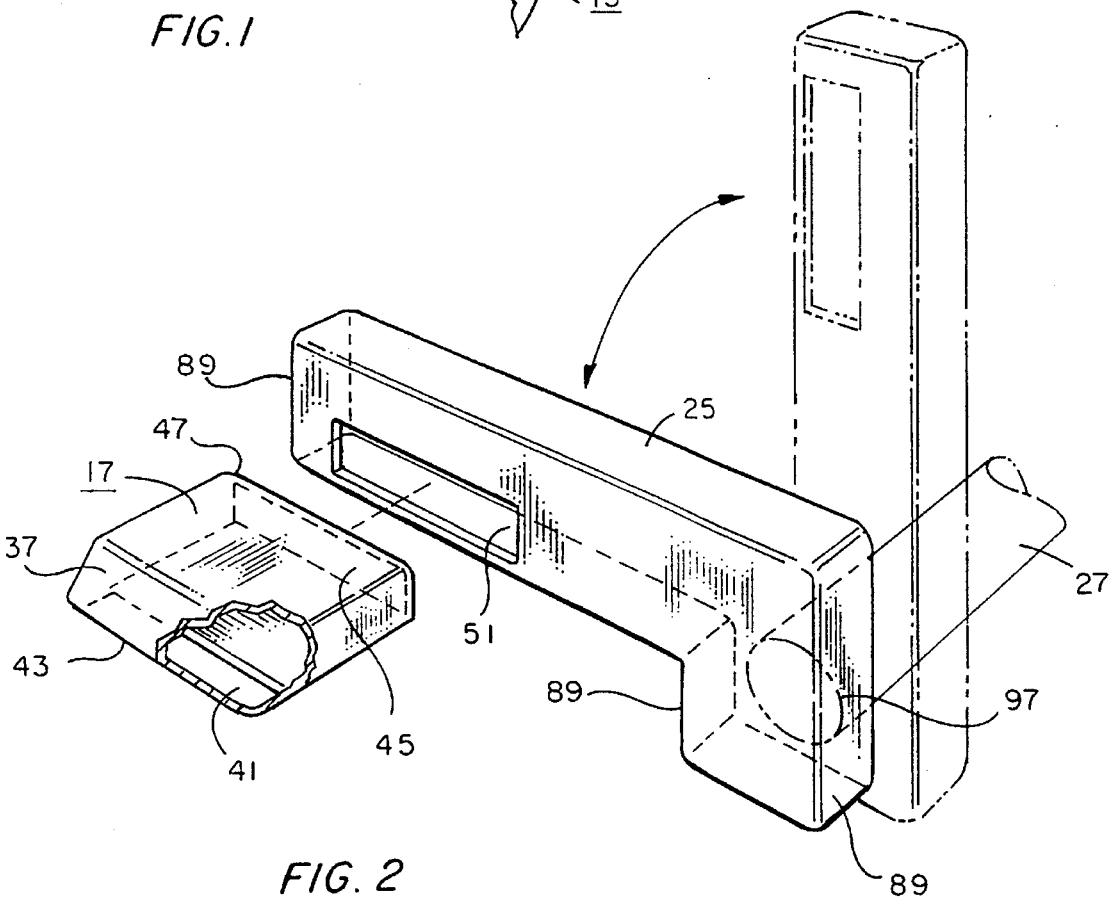
FIG. 2 is an exploded view of the intake member the manifold, and the ventilation pipe, showing the removability of the intake member from the manifold and the rotatablity of the manifold about the pipe.

As shown in FIG. 2, the intake member 17 is removably coupled to the manifold 25, and the manifold 25 may be rotated about the ventilation pipe 27 so that the intake member 17 and the manifold 25 and the toilet may be easily cleaned.

Figure 3:
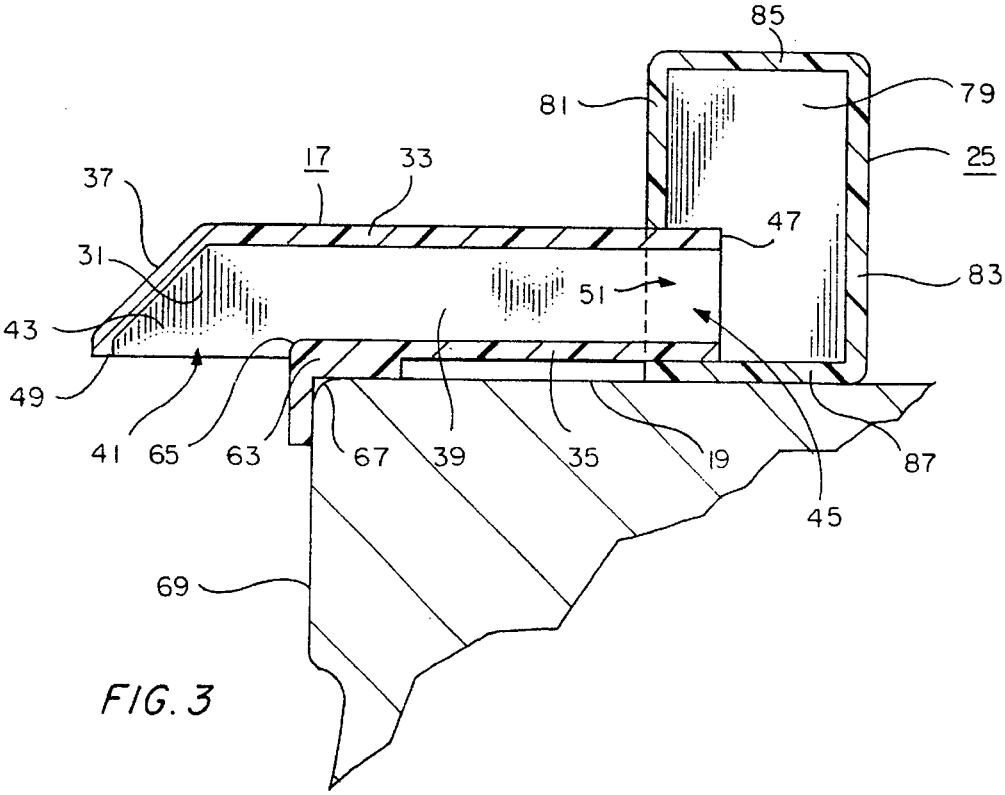
FIG. 3 is a cross-sectional view of the intake member and the manifold viewed across the manifold inlet with the intake member and manifold located on a toilet rim.

Referring now to FIGS. 1 and 3, the intake member 17 is a hollow cartridge through which air may be drawn from the toilet bowl 15 to the manifold 25. The intake member 17 has side walls 31 which extend transversely between and are integrally coupled to a top wall 33, a bottom wall 35, and a front wall 37. The walls 31, 33, 35, and 37 extend about and define a cavity 39 therebetween. In a preferred embodiment, the intake member 17 is formed of a rigid, injection molded plastic.

Air and biological fumes may be drawn through openings in the intake member 17. Referring to FIGS. 2 and 3, the member 17 has an intake opening 41 at an intake end 43 communicating with cavity 39, and an exhaust opening 45 at an exhaust end 47 of the intake member 17 also communicating with cavity 39. Air may freely flow through the intake member 17 along a path defined by the intake opening 41, the cavity 39, and the exhaust opening 45.

The intake end 43 of the intake member 17 is positioned over the toilet bowl 15 to draw odors directly out of the bowl 15. The intake opening 41 faces into the toilet bowl 15 extending from side wall 31 to side wall 31 between the front edge 49 of the front wall 37 and the bottom wall 35. The intake opening 41 is located downward facing the toilet bowl 15 for maximum efficiency in removing odor from the toilet bowl 15 which also prevents spillage of liquids from above into the member 17 into the cavity 39. The front wall 37 is angled back from its front edge 49 to the top wall 33 so that the intake end 43 may be unobtrusively extended over the toilet bowl 15.

The exhaust end 47 of the intake member 17 is coupled to the manifold 25 to deliver air and odors drawn through the intake opening 41 into the manifold 25. The exhaust end 47 has a rectangular cross-section formed by walls 31, 33, and 35 with the exhaust opening 45 and cavity 39 extending between the walls 31, 33, and 35. The exhaust end 47 slidably fits into a rectangular manifold inlet 51 to position the exhaust opening within the manifold 25 so odors may be drawn from the intake member 17 into the manifold 25. The manifold inlet 51 is only slightly larger than the exhaust end 47 of the intake member 17 so that the exhaust end 47 is held within the manifold 25 by a friction fit within the manifold inlet 51. As shown in FIG. 2, the exhaust end 47 may be slidably removed from the manifold inlet 51 so that the intake member 17 may be removed from the manifold 25 for cleaning.

Figure 4:
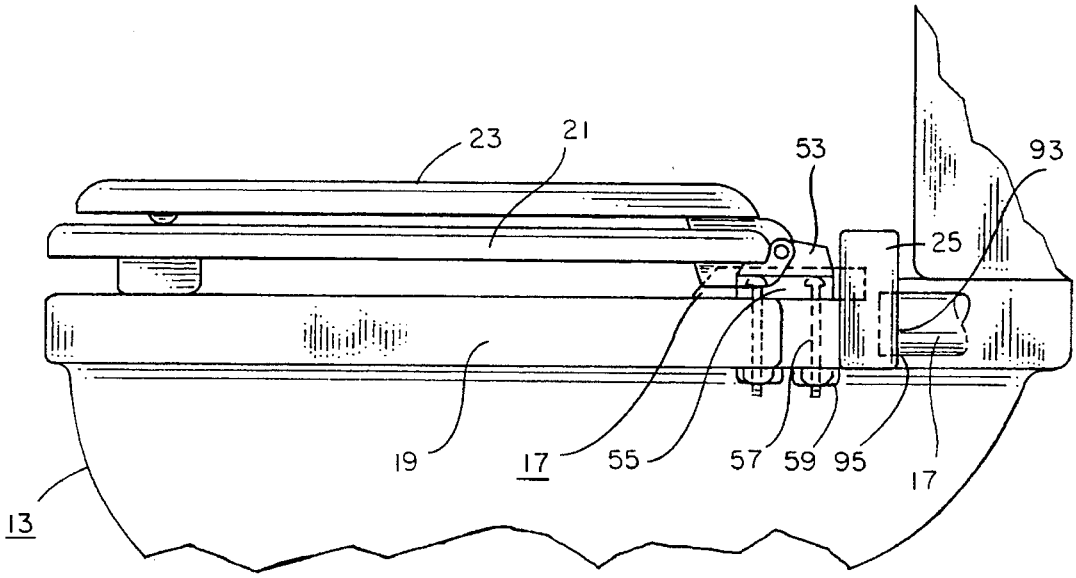
FIG. 4 is a side view of a toilet with the seat and lid closed, having the toilet ventilation system secured on the toilet.

Referring now to FIGS. 1 and 4, the intake member 17 extends from the toilet bowl 15 to the manifold 25 beneath the seat 21 and lid 23 of the toilet 13. The intake member 17 is positioned extending between the hinges 53 which pivotally couple the seat 21 and lid 23 to the toilet 13. The width of the intake member 17 between its side walls 31 permits the intake member 17 to fit between the hinges 53 while providing a sizable gap between the side walls 31 at the intake opening 41 through which odors may be drawn. The intake member 17 does not interfere with movement of the seat 21 and lid 23, and the seat 21 and lid 23 may be placed in an open position (FIG. 1 ) or a closed position (FIG. 4) with the intake member 17 on the toilet 13.

Hinge spacers 55 may be positioned between the hinges 53 and the toilet 13 to provide clearance for the intake member 17 to extend beneath the seat 21 and lid 23 of the toilet 13. As shown in FIG. 4, the hinge spacers 55 are coupled to the toilet 13 by connector bolts 57 which extend through the toilet rim 19 and are fastened thereto by nuts 59 underneath the toilet rim 19. The connector bolts 57 may be used to fasten the hinges 53 to the hinge spacers 55 and the toilet 13, or the hinges 53 may be attached to the hinge spacers 55 with separate bolts or screws. In a preferred embodiment the hinge spacers 55 are formed of a rigid plastic having a shape corresponding to the shape of the base 61 of the hinges 53 (See FIG. 1).

In a preferred embodiment, as shown in FIG. 3, the intake member 17 has a lip 63. The lip 3 is formed in the bottom wall 35 at the forward edge 65 of the bottom wall 35 adjacent the intake opening 41. The lip 63 extends transverse to the bottom wall 35 over the edge 67 of the toilet bowl rim 19 to abut a rear portion of the toilet bowl wall 69 thereby preventing movement of the intake member 17 towards the manifold 25. The lip 63 also extends along a portion of the bottom wall 35 below the bottom wall 35 to maintain the intake member 17 in a level orientation in the manifold inlet 51.

Referring now to FIGS. 1 and 3, the manifold 25 is a hollow "L" shaped member through which air and odors may be drawn from the intake member 17, located centrally on the toilet 13, to the ventilation pipe 27, located at the side 71 of the toilet 13. An upper portion 73 of the manifold 25 extends across the toilet 13 between the seat 21 and the toilet tank 75 from a central location behind the seat 21 to the side 71 of the toilet 13. A side portion 77 of the manifold 25 integrally couples the upper portion 73 at the side 71 of the toilet 13 and extends transverse to the upper portion 73 downward along the toilet side 71. The side portion 77 of the manifold 25 receives the ventilation pipe 27. In a preferred embodiment the manifold 25 is formed of a rigid plastic material. The manifold 25 has front and rear walls 81 and 83 coupled by top, bottom, and side walls 85, 87, and 89 the later of which extend transversely between the front and rear walls 81 and 83. The walls 81, 83, 85, 87 and 89 form the manifold cavity 79. The manifold inlet 51 is located extending through the front wall 81 of the manifold 25 communicating with the manifold cavity 79 at an intake end 91 in the upper portion 73 of the manifold 25. A manifold outlet 93 is located extending through the rear wall 83 of the manifold 25 communicating with the manifold cavity 79 at an outlet end 95 of the manifold 25. Air and odors may freely flow through the manifold 25 along a path defined by the manifold inlet 51, manifold cavity 79, and manifold outlet 93.

The manifold 25 is coupled between the intake member 17 and the ventilation pipe 27. As discussed above, the exhaust end 47 of the intake member 17 is slidably located in the manifold inlet 51. The manifold inlet 51 is positioned low in the front wall 81 of the upper portion 73 of the manifold 25 so the intake member 17 may extend beneath the seat 21 and the lid 23 while located in the manifold inlet 51. The exhaust opening 45 of the intake member 17 communicates with the manifold cavity 79 so that air and odors may be drawn from the intake member 17 into the manifold cavity 79 through the exhaust opening 75.

The ventilation pipe 27 has an inlet end 97 which is coupled to the manifold outlet 93 to receive air and odors drawn through the manifold cavity 79. The manifold outlet 93 is a circular aperture centered in the rear wall 83 at the outlet end 95 of the manifold 25 positioned below the toilet tank 75 so that the ventilation pipe 27 may be coupled therein. The inlet end 97 of the ventilation pipe 27 is cylindrical and has a slightly smaller diameter than the diameter of the manifold outlet 93. The inlet end 97 of the ventilation pipe 27 is located within the manifold outlet 93 and in held within the manifold outlet 93 by a friction fit. As shown in FIG. 2, the manifold 25 may be rotated about the inlet end 97 of the ventilation pipe 27 when the intake member 17 has been slidably removed from the manifold inlet 51. The rotated manifold 25 may be easily cleaned and then rotated back into its initial position.

Figure 6:
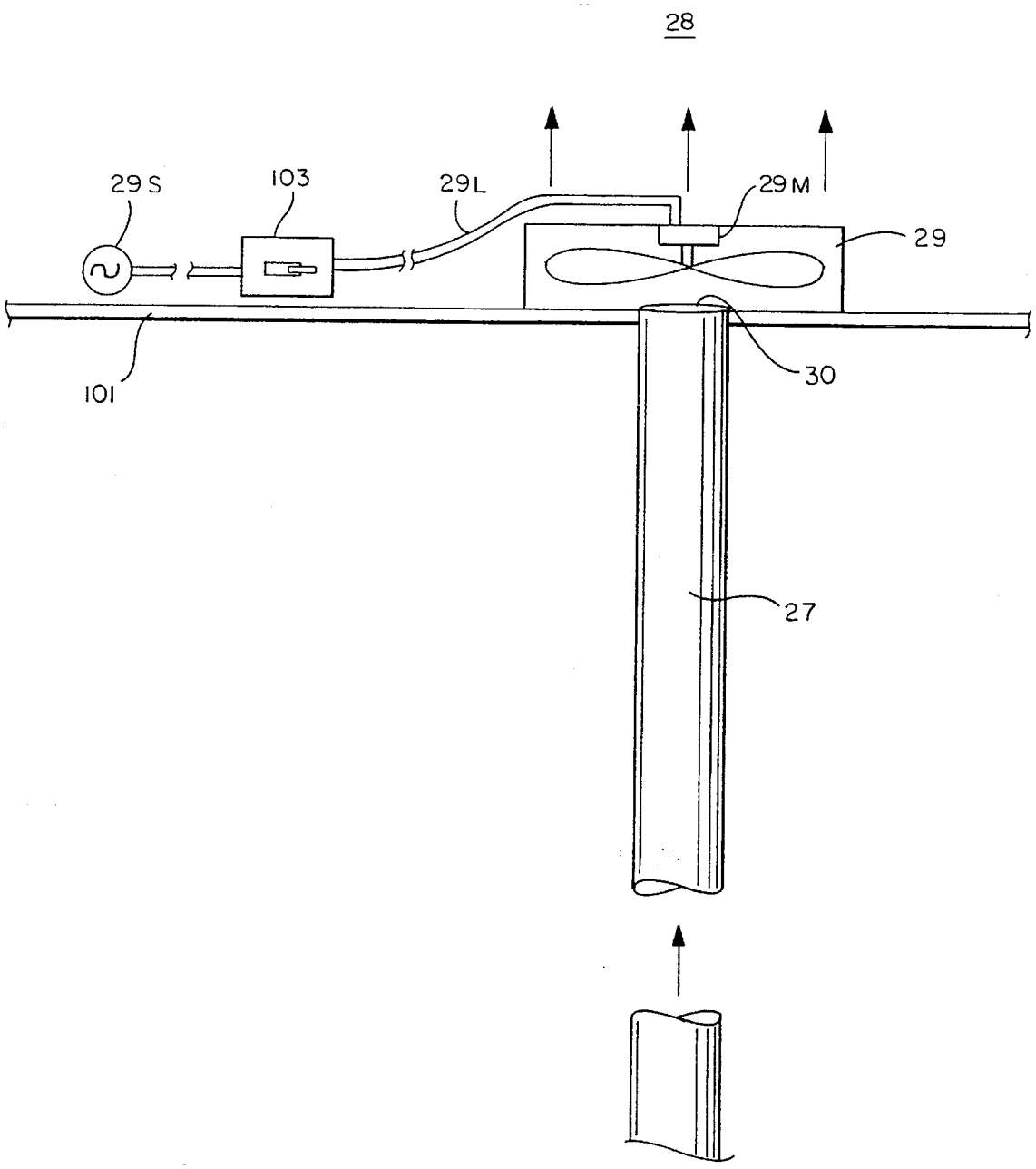
FIG. 6 is a schematic view of the fan of the toilet ventilation system.

As shown in FIGS. 1 and 6, the ventilation pipe 27 extends from the manifold outlet 93 to the ventilation fan 29 to deliver air and odors from the manifold 25 to the fan 29. The ventilation pipe 27 is positioned unobtrusively adjacent the toilet 13 extending from the manifold 25 beneath the toilet tank 75. Elbow joints 99 in the pipe 27 permit the pipe 27 to be situated about the tank 75. The pipe 27 extend from beneath the toilet tank 75 either through the ceiling 101 above the toilet 13 (shown in FIGS. 1 and 6) or through the wall adjacent to the toilet (not shown) to the ventilation end 30 of the pipe 27. The ventilation end 30 of the pipe 27 is coupled to the fan 29 so the fan 29 may draw air and odors through the pipe 27. The pipe 27 may be formed of rigid PVC piping or corrugated flexible tubing.

The ventilation fan 29 draws air and odors through the intake member 17, the manifold 25, and the ventilation pipe 27 and expels the air and odors into a ventilation area 28. The fan 29 is attached to a wall or a ceiling 101 adjacent the ventilation area 28 positioned to expel air drawn through the fan 29 into the ventilation area 28. The ventilation area 28 will typically be the outside of the room or building in which the toilet 13 is located.

The fan 29 is a conventional, commercially available electrical fan capable of drawing sufficient suction through the intake ember 17, manifold 25, and pipe 27 to effectively remove biological odors from the toilet 13. A conventional on-off switch 103 is provided to control the flow of current on leads 29L from source 29S to the electric motor 29M which drives the fan 29. The switch 103 is located in a position near the toilet 13 so that the switch 103 may be easily accessed to turn the fan 29 on and off as needed.

In operation, biological odors may be removed from the toilet 13 by placing the switch 103 in an "on" position to start the fan 29. The suction from the fan 29 causes odors in the toilet 13 to be drawn into the intake member 17 through the intake opening 41. The odors are then drawn through the intake member 17 and into the manifold 25 through the coupled exhaust opening 45 and manifold inlet 51. The odors are pulled through the manifold 25 into the ventilation pipe 27 through the coupled manifold outlet 93 and inlet end 97 of the pipe 27. The fan 29 draws the odors through the ventilation end 30 of the pipe 27 and expels them into the ventilation area 28. After the odors have been removed from the toilet 13 by the ventilation system 11 the switch 103 is placed in an "off" position to turn the fan 29 off.

As shown in FIG. 2, the ventilation system 11 may be cleaned after a significant period of use. In order to clean the system 11, the exhaust end 47 of the intake member 17 is slid out of the manifold intake 51 so that the intake member 17 and the toilet may be cleaned. After the intake member 17 has been removed, the manifold 25 is rotated about the pipe 27 in the manifold outlet 93 to position the manifold 25 for cleaning and to allow the toilet to be cleaned. After the intake member 17, the manifold 25 and the toilet have been cleaned, the ventilation system 11 is reassembled by rotating the manifold 25 back into its operating position and reinserting the intake member 17 into the manifold inlet 51 to position the intake member 17 on the toilet bowl rim 19.

Figure 7:
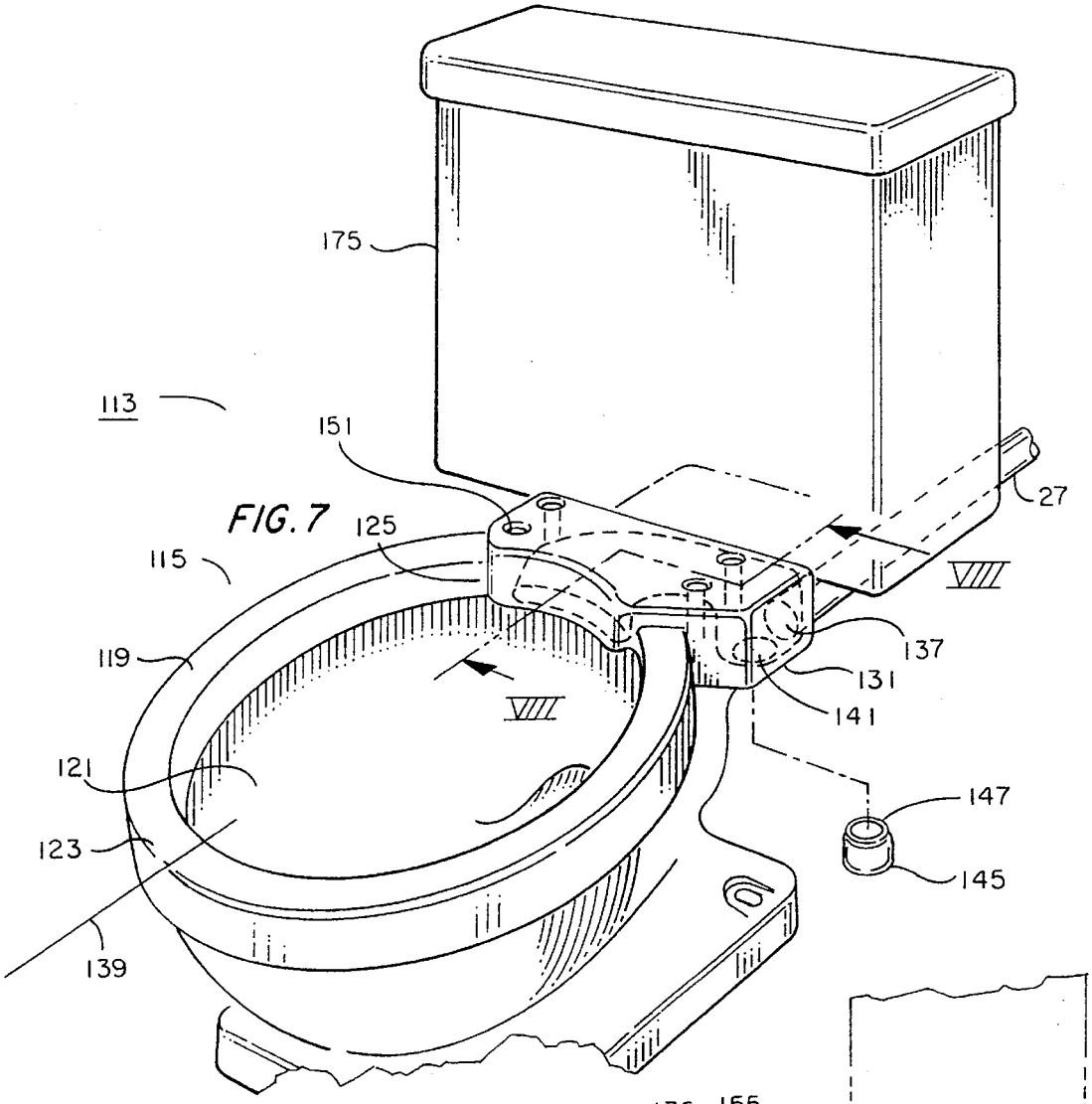
FIG. 7 is an isometric view of another embodiment of the invention.
Figure 8:
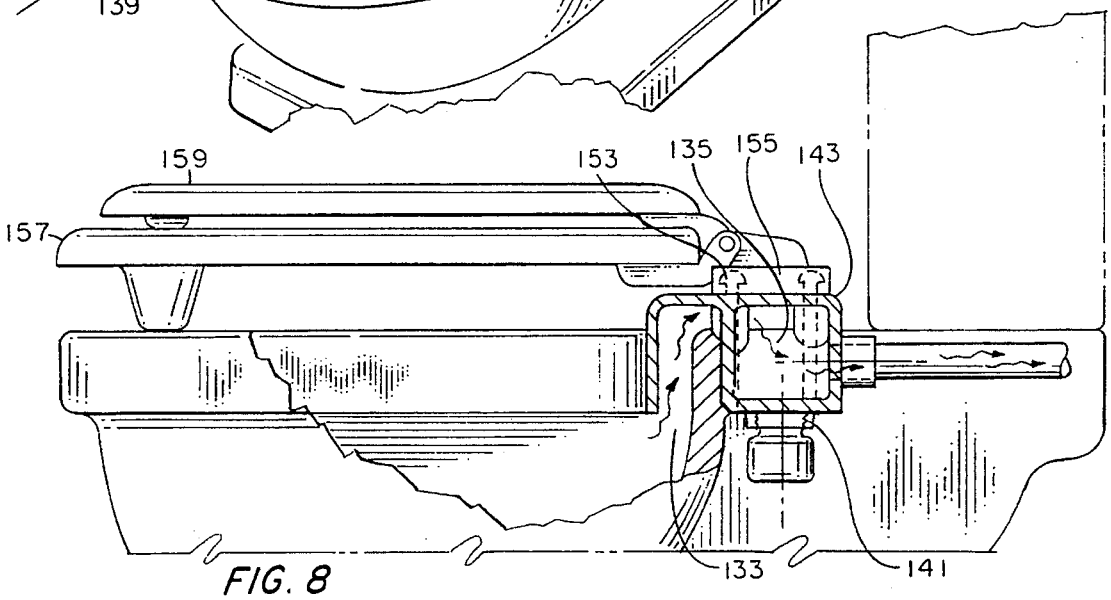
FIG. 8 is a cross-section of FIG. 7 taken along the lines 8—8 thereof.

Referring now to FIGS. 7 and 8, the toilet 113 comprises a modified toilet bowl 115 and a water tank 175. The bowl has an upper rim 119 surrounding a lower cavity 121 with a front end 123 and a rear end 125. Integrally coupled to the rear end of the rim 119 is a manifold 131 having a front inlet 133 leading to a chamber 135 and a rear outlet 137 in fluid communication with the chamber and located to one side of the center line 139 of the bowl. An exhaust pipe 27 is coupled to the outlet 137. The pipe 27 leads to an exhaust fan 29 as described previously. As shown the inlet 133 extends downward toward the cavity 121. A threaded opening 141 is formed through the wall 143 of the manifold 131 at the bottom for receiving a container 145 or sump having a threaded rim 147 which can be removably screwed into the threaded opening 141. The purpose of the container 145 is to receive any liquids that may pass to the chamber 135. In addition by removing the container or receptacle 145, water can be injected into the manifold either by way of the inlet 133 or opening 141 for cleaning the inside walls of the manifold.

The manifold 131 may be formed of ceramic material as that of the bowl 115. The manifold 131 may be molded or cast to the rim and bowl when the bowl is formed such that the bowl and manifold form a single unit formed together or the manifold 131 may be fixedly attached to the rim of an existing toilet bowl with suitable glue and/or bolts. The manifold 131 has suitable holes 151 formed through the walls thereof for receiving bolts 153 for use for attaching a base member 155 thereto to which the seat 157 and lid 159 are hinged.

The foregoing disclosure and the showings made in the drawings are merely illustrative of the principles of this invention and are not to be interpreted in a limiting sense.

I claim:

1. A toilet apparatus, comprising:

a toilet having a toilet bowl with an upper rim and an upper rear portion, a seat having a rear end, two spaced apart members pivotally coupling said rear end of said seat to said upper rear portion of said toilet such that a space is provided below said rear end of said seat and above said upper rear portion of said toilet, a hollow manifold comprising a front wall and a rear wall, said front wall and said rear wall each being L-shaped such that each of said front and rear walls comprises an elongated portion and an integral transverse portion at one end of said elongated portion whereby said manifold comprises an elongated manifold portion having a given length and a transverse manifold portion, a manifold inlet formed through said elongated portion of said front wall, a manifold outlet formed through said rear wall at a position such that said manifold outlet extends through at least a portion of said transverse portion of said rear wall, said elongated portion of said manifold being generally rectangular in cross section in a plane transverse to said given length, a hollow intake member having front and rear ends with inlet and outlet openings therein respectively, an exhaust conduit located on one side of said toilet, said manifold outlet being coupled to said exhaust conduit for movement of said manifold between a first position behind said rear end of said seat and said two spaced apart members where said inlet of said manifold is near said rear upper portion of said toilet and a second position where said inlet of said manifold is spaced from said rear upper portion of said toilet, when said manifold is in said first position, said elongated portion of said manifold including said elongated portion of said front wall extends across said upper rear portion of said toilet behind said rear end of said seat and behind said two spaced apart members such that said manifold may be moved directly to said second position when said rear end of said intake member is uncoupled from said inlet of said manifold, said rear end of said intake member being removably coupled to said inlet of said manifold by way of said space below said rear end of said seat when said manifold is in said first position with said front end of said intake member extending to a position relative to said toilet bowl to provide an air and odor passage from said toilet bowl to said exhaust conduit by way of said intake member and said manifold when said manifold is in said first position and to allow said manifold to be moved to said second position when said rear end of said intake member is uncoupled from said inlet of said manifold to facilitate cleaning of said toilet and said manifold, said intake member being removable from said toilet by way of said space below said rear end of said seat, said manifold being movable between said first and second positions while said rear end of said seat is pivotally coupled to said two spaced apart member.

2. The toilet of claim 1, wherein:

said manifold is pivotally coupled to said exhaust conduit for pivotal movement behind said seat between said first and second positions when said intake member is uncoupled from said manifold.

3. The toilet of claim 1, wherein:

said toilet has a tank extending upward from a lower level to an upper level, said front and rear walls of said manifold are generally flat, when said manifold is in said first position, said elongated portion of said manifold extends across said toilet between said tank and said two spaced apart members and said transverse portion extends downward along said one side of said toilet such that said manifold outlet is located below said lower level of said tank.

4. The toilet of claim 3, wherein:

said exhaust conduit extends to said manifold outlet from below said tank.

5. The toilet of claim 4, wherein:

said manifold is pivotally coupled to said exhaust conduit for pivotal movement behind said seat between said first and second positions when said intake member is uncoupled from said manifold.

6. The toilet of claim 1, comprising:

means located to draw air and odor through a remote end of said exhaust conduit from said toilet by way of said intake member, manifold, and exhaust conduit.

* * * * *